US007500808B2

(12) United States Patent
Dettmer et al.

(10) Patent No.: US 7,500,808 B2
(45) Date of Patent: Mar. 10, 2009

(54) DOUBLE T-SHAPED STEEL SHEET PILING PROFILE

(75) Inventors: Wolfgang Dettmer, Wendeburg (DE); Dietmar Grotmann, Heilberscheid (DE); Arved Haasler, Peine (DE)

(73) Assignee: Peiner Träger GmbH, Piene (DE)

( * ) Notice: Subject to any disclaimer, the term of this patent is extended or adjusted under 35 U.S.C. 154(b) by 436 days.

(21) Appl. No.: 10/569,256

(22) PCT Filed: Apr. 20, 2004

(86) PCT No.: PCT/DE2004/000857

§ 371 (c)(1),
(2), (4) Date: Feb. 21, 2006

(87) PCT Pub. No.: WO2005/025770

PCT Pub. Date: Mar. 24, 2005

(65) Prior Publication Data

US 2006/0228574 A1 Oct. 12, 2006

(30) Foreign Application Priority Data

Aug. 25, 2003 (DE) ..... 103 39 957

(51) Int. Cl.
*E02D 5/04* (2006.01)
*B21B 1/08* (2006.01)

(52) U.S. Cl. ..... 405/276; 405/277

(58) Field of Classification Search ..... 405/276–281
See application file for complete search history.

(56) References Cited

U.S. PATENT DOCUMENTS

| | | | | | |
|---|---|---|---|---|---|
| 3,703,085 | A | * | 11/1972 | Wogerbauer | 405/276 |
| 4,942,753 | A | * | 7/1990 | Willeke | 72/178 |
| 5,447,393 | A | * | 9/1995 | Yeates et al. | 405/276 |
| 5,671,630 | A | * | 9/1997 | Grober | 72/177 |
| 5,921,717 | A | * | 7/1999 | Dawson | 405/279 |
| 6,042,306 | A | * | 3/2000 | Arndts et al. | 405/279 |
| 6,106,201 | A | * | 8/2000 | Bourdouxhe | 405/281 |
| 6,190,093 | B1 | * | 2/2001 | Bastian et al. | 405/278 |
| 6,443,664 | B1 | * | 9/2002 | Horan et al. | 405/279 |

FOREIGN PATENT DOCUMENTS

| | | |
|---|---|---|
| DE | 613 210 C | 2/1936 |
| JP | 56 117803 A | 9/1981 |

OTHER PUBLICATIONS

"Hoesch Stahlspundwände" 1/03 ["*Hoesch Steel Piling Walls*"] and/or "Peiner Stahlspundwände" 3/02 ["*Peiner Steel Piling Walls*"], HSP Hoesch Spundwand und Profil GmbH, Dortmund, Germany.
"Peiner Stahlspundwände" 3/02) ["*Peiner Steel Piling Walls*"], Preussag Stahl.

* cited by examiner

*Primary Examiner*—Frederick L Lagman
(74) *Attorney, Agent, or Firm*—Henry M. Feiereisen; Ursula B. Day

(57) ABSTRACT

The invention relates to a double T-shaped steel piling wall profile (1), which is produced by hot rolling and which has two flange sections (3) that are centrally joined via a connecting member (8). The flange sections have connecting end sections (4), which are adjoined thereto and which have a club-shaped design.

12 Claims, 1 Drawing Sheet

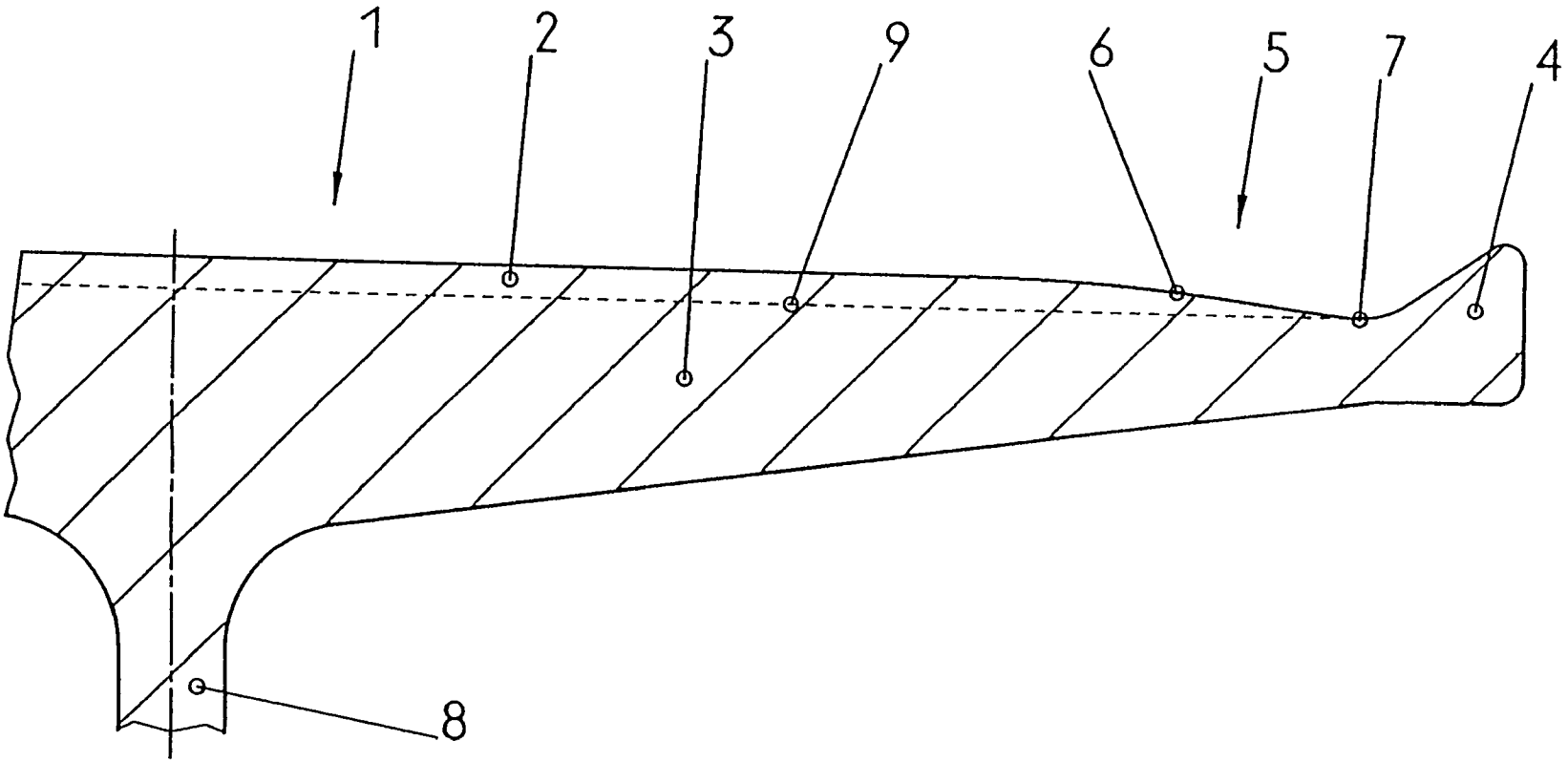
1
2
3
9
6
5
7
4
8

DOUBLE T-SHAPED STEEL SHEET PILING PROFILE

BACKGROUND OF THE INVENTION

The invention relates to a double T-shaped steel piling wall profile.

Double T-shaped piling wall profiles are known, for example, as Peiner steel piling walls (see, for example, section of the delivery program "Hoesch Stahlspundwände" January 2003 ["*Hoesch Steel Piling Walls*"] and/or "Peiner Stahlspundwände" March 2002 ["*Peiner Steel Piling Walls*"], available from HSP Hoesch Spundwand und Profil GmbH, Dortmund, Germany).

These company brochures describe hot-rolled piling wall profiles with two flange sections which are connected in the center by a web. Club-shaped connecting end sections adapted to receive interlocks adjoin the flange sections. The flange sections are oriented at least on the outside essentially horizontally. The inside of the flange can have a wedge-shaped taper from the flange center to the flange end, or can, like the outside of the flange, extend essentially horizontally.

The input stock for these piling wall profiles produced by hot rolling is in the form of either slabs, blocks or so-called beam blanks, wherein the latter are cast with a cross-section that is close to the final dimensions.

When using a heated slab or a block, the essentially rectangular cross-section is transformed in a shaping mill into a shape that is close to the final dimensions of the double-T profile, and subsequently rolled to the desired final dimension in a finishing mill stage, which includes at least a universal mill and an edger. When using the beam blanks, blooming can be limited to a few reduction passes, because the dimensions of the cast cross-section are already close to the final dimensions.

The finishing mill stage consists of a roller set for machining the outside and the inside of the rough profile.

The double T-shaped piling walls are used, for example, for supporting sudden height changes in the terrain and for shoring up trenches and port facilities. The piling wall profiles must be able to withstand large horizontal forces which cause a corresponding bending load of the piling walls perpendicular to the piling wall wall. The dimensions are typically determined by the bending load which the piling wall profile must be able to absorb from the lateral earth and/or water pressure via the section modulus.

Depending on the load to be absorbed, the piling wall profiles can be connected via the interlocks either with one another, thereby producing a closed wall from individual support elements with a high section modulus, or the piling wall profiles can be used as a mixed piling wall, whereby for example U-shaped or Z-shaped fill elements are connected by the interlock to the double T-shaped profile. In the latter case, only the double T-shaped profiles function as support elements, whereas the fill elements essentially only perform a sealing function.

Double T-shaped piling wall profiles are offered essentially in different lengths and with flange sections having different wall thicknesses, depending on the required section modulus.

The club-shaped connecting end sections of the flange typically have a standard geometry, so that all standard profiles can be connected with each other or in combination with other profiles by using a single interlock.

The commercially available standard piling wall profiles frequently do not satisfy the section moduli required by a static design. For example, a standard delivery program of a company may not be able to deliver a piling wall profile with a required section modulus, or the required section modulus may fall between two available standard piling wall profiles.

If the required section modulus falls between two available standard piling wall profiles, then it makes often no economic sense to select the next larger profile which may be significantly more expensive. If a standard delivery program is unable to supply the required section modulus, then a completely new piling wall profile may have to be produced.

For producing a new piling wall profile by hot rolling, an expensive roller set must be procured at least for the finishing mill stage, and a large inventory may be required and expensive rolling tests, until a high-quality product is ready for sale.

The present technology offers various possibilities for increasing the section modulus of a standard profile, without having to either select an uneconomical profile or to produce an entirely new profile with a different geometry (essentially related to the overall height and the flange thickness), which would be a complex and expensive process.

To eliminate these disadvantages, attempts have been made to increase the section modulus according to the customer requirements while maintaining the geometry of the standard profile.

In one embodiment, which has been used and proven effective in practice, steel lamellae have been welded to one or both exterior flange surfaces of the piling wall profile (see excerpts from the delivery program "Peiner Stahlspundwände" March 2002) ["*Peiner Steel Piling Walls*"]. These lamellae are preferably arranged in the region of the highest bending moment.

Welding these lamellae is expensive and adds costs, because the piling wall profile must be straightened due to the welding stress.

In another approach, the section modulus of a standard profile can be increased to attain a greater average wall thickness in the flange by moving the finishing rollers apart during the rolling process (see excerpts from the delivery program "Hoesch Stahlspundwände" January 2003 or "Peiner Stahlspundwände" March 2002).

The flange thickness of wedge-shaped flange sections is given as an average value which corresponds to the cross-sectional area of the flange divided by the overall width of the profile. The average wall thickness of profiles with parallel flanges corresponds to the nominal wall thickness in the flange section.

The size of the opening between the outside rollers of the finishing roller stage which determines the average flange thickness is increased by a value in the range of millimeters, which increases the overall height of the profile and hence also the average wall thickness of the flange.

Disadvantageously, the pass of the outer rollers also enlarges the club-shaped geometry of the connecting end section, in addition to increasing the average flange thickness.

The tolerances in the connecting region are relatively tight to enable the club-shaped section to securely engage with the standard interlock to withstand the load on the piling wall. If the average wall thickness increases too much, then the dimension of the club-shaped section would also increase to a point where the standard interlock can no longer be pushed over the club-shaped section.

With this approach, new interlocks would have to be produced which can be quite expensive.

It is therefore an object of the invention to provide a piling wall profile which can overcome the aforedescribed disadvantages of conventional profiles.

SUMMARY OF THE INVENTION

According to the teachings of the invention, the object is solved by a double T-shaped piling wall profile, where the average wall thickness for a defined standard profile is increased in the flange sections while maintaining a constant dimension of the connecting end section, with the increase in the average wall thickness being produced by hot rolling the piling wall profile.

The invention also relates to a double T-shaped piling wall profile made of steel and produced by hot rolling, with two flange sections connected in the center by a web, with adjoining club-shaped connecting end sections adapted to receive interlocks, wherein one or both flange sections have a convex bulge between the club-shaped connecting end sections, as viewed in cross-section.

The term "convex-like" is meant to indicate an embodiment where, for example, the bulge is arcuate, or increases and then decreases again in the form of an arch and is linear in the intermediate region, or increases and then decreases again linearly in the intermediate region, while also being linear in the intermediate region.

Increasing the wall thickness only in the flange section has the advantage that even large increases in the wall thickness can be produced cost-effectively by hot rolling, without changing the dimensions club-shapes sections. This eliminates the otherwise high costs associated with welding the lamellae or providing new interlocks.

The wall thickness according to the invention is increased during hot rolling preferably in the finish rolling stage, wherein the finish rollers for machining the outside of at least one outer surface of the flange have a surface contour necessary to produce the increased wall thickness.

According to another advantageous feature of the invention, the increased wall thickness can be produced on the outside and/or inside on one or both flange sections.

This approach can significantly enhance the flexibility to meet the aesthetical or technical customer requirements.

According to another advantageous embodiment, the increase in the wall thickness can be obtained with commercially available piling wall profiles having either parallel or non-parallel flanges.

The increase in the wall thickness of only the flange section produced according to the invention during hot rolling gradually changes over into the club-shaped connecting end section via a step-less transition.

This approach advantageously eliminates a transition having relatively sharp edges, which are produced, for example, when welding lamellae on to a rectangular cross-section, which can cause stress- and corrosion-related problems.

In another advantageous embodiment, the step-less transition includes a conically tapered section and an arcuate section adjoining the connecting end section.

The surface contour of the increased wall thickness can be adapted to any shape and form required by the customer. Feasible are, for example, an essentially rectangular or concave or convex surface contour.

BRIEF DESCRIPTION OF THE DRAWING

FIG. 1 shows a portion of the piling wall profile with a connecting end section Additional features, advantages and details of the invention will now be described with reference to the single FIGURE.

DETAILED DESCRIPTION OF PREFERRED EMBODIMENTS

Because the double T-shaped piling wall profile is mirror symmetric, only a portion of the piling wall profile produced according to the invention is shown in cross-section.

The piling wall profile 1 includes flange sections 3 which are connected in the center. Club-shaped connecting end sections 4 adjoin the flange sections 3 for receiving interlocks (not shown in the figure).

The outside contour of the flange section of a hot-rolled standard piling wall profile is indicated by the dotted profile line 9 which is oriented essentially horizontally.

In the depicted exemplary embodiment, the inside of the flange sections 3 is shown as being tapered toward the outside in form of a wedge. However, parallel flange sections 3, with the adjoining connecting end section 4 adjoining the flange sections 3, can also be produced.

Starting with the outside dimension of the standard piling wall profile indicated by the profile line 9, the increase in the wall thickness 2 limited to the flange section 3 during the hot rolling process is attained by grooving the finishing rollers. According to the invention, the wall thickness 2 can be increased on one or both outer surfaces and/or on one or both inner surfaces of the flange sections 3.

As shown in the figure, the club-shaped connecting end section 4 has the original geometry of the standard profile, so that the standard interlock can still be used.

Advantageously, the wall thickness 2 is increased only to a point where the maximum profile height of the standard profile, as defined by the vertical spacing between the club tips of the opposing flange halves, is not exceeded. However, the increase in the wall thickness 2 may be greater, depending on customer requirements.

It is also evident from the diagram in the figure that the transition 5 from the increased wall thickness 2 to the club-shaped connecting end section 4 does not include a step.

In the depicted exemplary embodiment, the surface contour of the increased wall thickness 2 extends essentially horizontally, and transitions with a conically shaped section 6 and adjoining arcuate section 7 into the connecting end section 4.

Optionally, the surface contour of the increased wall thickness 2 can also have a sinusoidal, concave or convex shape, depending on the customer requirements.

What is claimed is:

1. A double T-shaped piling wall profile made of steel, comprising:

two flange sections, each having an adjoining club-shaped connecting end section adapted to receive an interlock;

a web connecting the flange sections;

wherein, as viewed in cross-section, at least one of the two flange sections has a convex bulge disposed between the club-shaped connecting end sections, with the convex bulge increasing an average wall thickness in the flange section while the connecting end section maintains a constant dimension, with the increase in the average wall thickness being produced by hot rolling the piling wall profile.

2. The piling wall profile of claim 1, wherein the increased wall thickness is produced during finish rolling.

3. The piling wall profile of claim 1, wherein the increased wall thickness is produced on at least one of an outside or an inside of a flange section.

4. The piling wall profile of claim 1, wherein the two flange sections are mutually parallel.

5. The piling wall profile of claim 1, wherein the two flange sections are not parallel to one another.

6. The piling wall profile of claim 1, wherein the average wall thickness in the flange section is increased independent of a geometry of the adjoining club-shaped connecting end section.

7. The piling wall profile of claim 3, wherein the increased wall thickness on the outside or inside of the flange gradually changes over via a step-less transition into the club-shaped connecting end section.

8. The piling wall profile of claim 7, wherein the step-less transition comprises a conically tapered section and an adjoining arcuate section.

9. The piling wall profile of claim 1, wherein the flange section having the increased wall thickness has a sinusoidal surface contour.

10. The piling wall profile of claim 1, wherein the flange section having the increased wall thickness has an essentially rectangular surface contour.

11. The piling wall profile of claim 1, wherein the flange section having the increased wall thickness has a concave or convex surface contour.

12. A method for producing a double T-shaped piling wall profile made of steel and having two flange sections, each having an adjoining club-shaped connecting end section adapted to receive an interlock, and a web connecting the flange sections, with the convex bulge increasing an average wall thickness in the flange section while the connecting end section maintains a constant dimension, the method comprising the steps of:

providing a set of finish rollers having a surface contour shaped to produce, as viewed in cross-section, a convex bulge with an increased average wall thickness between the club-shaped connecting end sections in at least one of the two flange sections, providing a prefabricated rough profile having dimensions close to final dimensions of the piling wall profile, and hot rolling the rough profile between the set of finish rollers to produce the piling wall profile with the convex bulge.

* * * * *